US011059611B2

(12) United States Patent
Vollenkemper

(10) Patent No.: US 11,059,611 B2
(45) Date of Patent: Jul. 13, 2021

(54) APPARATUS AND METHOD FOR COMPACTING PACKAGES FILLED WITH BULK MATERIAL

(71) Applicant: HAVER & BOECKER OHG, Oelde (DE)

(72) Inventor: Willi Vollenkemper, Gütersloh (DE)

(73) Assignee: HAVER & BOECKER OHG, Oelde (DE)

( * ) Notice: Subject to any disclaimer, the term of this patent is extended or adjusted under 35 U.S.C. 154(b) by 50 days.

(21) Appl. No.: 16/617,164

(22) PCT Filed: May 30, 2018

(86) PCT No.: PCT/EP2018/064261
§ 371 (c)(1),
(2) Date: Nov. 26, 2019

(87) PCT Pub. No.: WO2018/220055
PCT Pub. Date: Dec. 6, 2018

(65) Prior Publication Data

US 2020/0108956 A1 Apr. 9, 2020

(30) Foreign Application Priority Data

May 30, 2017 (DE) ..... 102017111806.3

(51) Int. Cl.
*B65B 1/26* (2006.01)
*B65B 1/22* (2006.01)
(Continued)

(52) U.S. Cl.
CPC ..... *B65B 1/26* (2013.01); *B65B 1/22* (2013.01); *B65B 1/24* (2013.01); *B65B 1/48* (2013.01); *B65B 1/44* (2013.01)

(58) Field of Classification Search
CPC .... B65B 1/26; B65B 1/22; B65B 1/24; B65B 1/48; B65B 1/44; B65B 1/20
See application file for complete search history.

(56) References Cited

U.S. PATENT DOCUMENTS 7,866,353 B2 1/2011 Combrink
9,540,123 B2 * 1/2017 Vollenkemper ..... B65B 57/145
(Continued)

FOREIGN PATENT DOCUMENTS

CN 203244875 U 10/2013
CN 103434664 A 12/2013
WO 2007/101836 A1 9/2017

OTHER PUBLICATIONS

German Search Report from German Patent Application No. 102017111806.3, dated Mar. 9, 2018.
(Continued)

*Primary Examiner* — Nicolas A Arnett
(74) *Attorney, Agent, or Firm* — Greer, Burns & Crain, Ltd.

(57) ABSTRACT

A compacting device and method is provided for compacting bulk material in an open package, the compacting device including a poker compactor accommodated on a carrier device. The poker compactor includes a gas-permeable outer wall connected with a suction duct. The poker compactor is suitable to be inserted into an open package for the poker compactor to come into contact with the bulk material to degas and compact the bulk material in the open package. The poker compactor has a longitudinal axis around which it is pivotally accommodated.

32 Claims, 4 Drawing Sheets

(51) Int. Cl.

| | |
|---|---|
| ***B65B 1/24*** | (2006.01) |
| ***B65B 1/48*** | (2006.01) |
| *B65B 1/44* | (2006.01) |

(56) References Cited

U.S. PATENT DOCUMENTS

| | | | | |
|---|---|---|---|---|
| 9,650,161 | B2 * | 5/2017 | Wehling | B65B 1/36 |
| 10,589,881 | B2 * | 3/2020 | Vollenkemper | B65B 63/02 |
| 10,625,890 | B2 * | 4/2020 | Vollenkemper | B65B 1/28 |
| 10,661,921 | B2 * | 5/2020 | Wehling | B65B 43/26 |
| 2004/0182469 | A1 | 9/2004 | Concetti | |
| 2018/0009552 | A1 * | 1/2018 | Wehling | B65B 43/26 |
| 2019/0118981 | A1 | 4/2019 | Kuss | |

OTHER PUBLICATIONS

International Search Report & Written Opinion from International Patent Application No. PCT/EP2018/064261, dated Sep. 27, 2018.
Search Report received in Chinese Application No. 2018800358465 dated Nov. 20, 2020.

* cited by examiner

APPARATUS AND METHOD FOR COMPACTING PACKAGES FILLED WITH BULK MATERIAL

BACKGROUND

The present invention relates to a compacting device and a method in particular for compacting packages filled with bulk materials wherein the compacting device comprises a poker compactor accommodated on a carrier device and provided for entering an open-top package and sucking air out of the bulk material contained therein.

A great variety of compacting devices for compacting bulk materials filled into open packages have been disclosed in the prior art. For example apparatuses and methods have been disclosed wherein a bottom vibrator applies vibrations to the bottom end of the open package from beneath to deaerate and thus compact the bulk material contained in the open package.

Moreover, compacting devices have been disclosed where a vacuum lance enters the open-top end of an open package from above and through a porous outer surface sucks air directly out of the bulk material, thus contributing to compacting the bulk material. Both of these known systems show benefits and drawbacks. Therefore, WO 2016/116427 A1 has disclosed an apparatus and a method for filling an open package using a compacting device with a poker compactor, the poker compactor entering an open package from above. The poker compactor enters the bulk material and sucks air out of the bulk material through its gas-permeable vacuum suction wall. Concurrently, a vibration exciter is disposed in the interior of the poker compactor to generate a vibrating movement of the poker compactor and thus further increase the compacting efficiency.

However, all of the compacting units entering an open package from above and in particular those compacting units which suck air out of the interior of the bulk material by way of a vacuum, show the drawback that a comparatively large quantity of bulk material adheres to the outer surface of the compacting unit as the compacting unit is removed. Since ambience cleanliness is gaining importance, these compacting devices show drawbacks which compacting devices acting only from the outside inherently do not show.

It is therefore the object of the present invention to provide a compacting device which allows to achieve better cleanliness.

SUMMARY

This object is solved by a compacting device having the features of claim 1 and a method having the features of claim 19. Preferred specific embodiments of the invention are the subjects of the subclaims. Further advantages and features of the present invention can be taken from the general description and the description of the exemplary embodiments.

A compacting device according to the invention comprises a poker compactor accommodated on a carrier device for compacting bulk material in an open package. The poker compactor comprises an outer wall that is at least partially gas-permeable and connected with a suction duct. The poker compactor is suitable and provided to be inserted into an open package to cause the poker compactor to come into contact with the bulk material and to degas and compact the bulk material in the open package. The poker compactor has a longitudinal axis around which it is pivotally accommodated.

The compacting device according to the invention has many advantages. A considerable advantage of the compacting device according to the invention consists in the fact that the poker compactor is accommodated for pivoting around its (in particular central) longitudinal axis. This allows the poker compactor to pivot around its longitudinal axis following compacting, so that any bulk material particles adhering to or caking on the outer surface or the outer wall of the poker compactor are loosened or wiped off (due to inherent friction in the bulk material). This considerably reduces the quantity of bulk material transported outwardly with removal out of the open package. Contamination of the ambience is considerably reduced.

A poker compactor in the sense of the present invention is understood to mean a device for compacting including at least one body, the body showing the shape of a bottle or a rod or a lance or similar or comparable form. A poker compactor in the sense of the present invention may in particular also be understood to mean a vacuum lance, a vacuum rod, a suction lance, a filter stick or a filter candle.

It is possible for the compacting device to comprise two, three, four or more poker compactors. One poker compactor each, or two or more poker compactors may be disposed e.g. in a station of a system or packaging system. It is possible to provide a number of stations of a system or packaging system with one poker compactor or two or more poker compactors. This allows the poker compactors to enter into and retract out of and operating in a number of stations connected in series so as to increase compacting overall.

A swivel motion may be understood to mean a motion around a defined (and e.g. specified) or an undefined (and e.g. ensuing during operation) angular range. The rotational angle may be less than one full revolution (360°) and it may be larger, even comprising multiple revolutions.

The term "rotatable" or "swiveling" may be understood to mean a rotary motion whose rotational angle is limited or unlimited, and also a continuous rotation of at least one poker compactor or all the poker compactors. It is also possible for at least one poker compactor to be rotatable only around a defined angular range and for at least one other poker compactor to be continuously rotatable.

A swivel motion preferably occurs as the swivel motion begins, in a rotational direction in which a screw thread, with which the poker compactor is for example screwed, tightens. This reliably prevents automatic disengagement in operation. However, if the poker compactor is fastened e.g. in a form-fit, the swivel motion may basically be chosen to begin in any desired rotational direction. In particular in the case of swivel motions performed back and forth multiple times or at increased frequency.

The poker compactor in particular performs swivel motions around its own axis. The poker compactor is in particular accommodated on the carrier device for rotation around its central rotation axis. Pivoting is preferably performed while the poker compactor is received in the open package. The outer wall of the poker compactor is at least partially formed by a gas-permeable, outer vacuum suction wall. The poker compactor comprises in particular at least one contact portion that is provided for coming into contact with the bulk material. In preferred specific embodiments the poker compactor is configured so that the contact portion or contact portions is/are preferably symmetrical and in particular rotationally symmetrical and at least partially air-permeable.

The compacting device according to the invention may be employed in packaging systems and packaging machines of many different kinds. Employment is possible for filling bulk materials into small and miniature bags. Employment is also possible for filling bulk materials into bags of different sizes and in particular open-mouth bags. Employment is likewise possible and preferred for filling bulk materials into so-called "big bags" so as to enable compacting bulk materials in open packages with volumetric capacities ranging for example from a few 100 g up to far more than 100 kg.

The invention allows to compact bulk material in any desired open packages. It is also possible to additionally use further compacting devices acting on the bulk material in the package in the same or different ways.

In a preferred specific embodiment a pivot device is provided by means of which the poker compactor can in particular be controlled by a control device for pivoting. The pivot device is in particular received on the carrier device. Preferably the pivot device comprises a cylinder drive and enables in particular pivoting back and forth. The rotational angle is basically arbitrary and may be up to and above 20°, 30°, 45° or 60° or 90° or also 180° or even 360°.

In all the configurations it is particularly preferred for the longitudinal axis of the poker compactor to be disposed or to extend within the cross section of the poker compactor. It is particularly preferred for the poker compactor and in particular at least the outer wall of the poker compactor to be rotationally symmetrical. Then it is particularly preferred for the longitudinal axis of the poker compactor to be the axis of symmetry of the outer wall or the poker compactor. Then this means that the poker compactor is pivotable around its axis of symmetry. Then the poker compactor optionally only performs a swivel motion in the bulk material. Such a swivel motion is particularly effective in removing bulk material from the outer surface of the outer wall of the poker compactor. Any adhering bulk material is virtually sheared off the outer surface by way of internal friction in the bulk material.

Alternately it is possible for the rotation axis to not be entirely identical with the axis of symmetry of the poker compactor so as to show for example a slight wobbling motion or a slightly eccentric rotary motion. An eccentric rotary motion may also lead to the desired success wherein slight eccentricity is preferred.

In all the configurations it is particularly preferred for the poker compactor to be configured substantially tubular at least over a considerable longitudinal section. The poker compactor respectively the tube device of the poker compactor may for example consist of, or at least comprise, a bottom tube unit and a top tube unit. The bottom tube unit and the top tube unit may be separated from one another in a separation point. In particular the bottom tube unit can be exchanged at the separation point to provide for exchanging the pertaining tube unit in case of wear of the bottom tube unit (top tube unit).

In all the configurations preferably at least one aeration valve is provided for controlled aeration or application of an air impulse or pressure surge on the filter device (from the interior). This enables cleaning any adhering particles from the filter device by an air blast from the interior.

In preferred configurations it is possible for the top tube unit to have a tight outer wall. The bottom tube unit is at any rate partially provided with a vacuum suction wall on the outer wall for sucking air out of the bulk material into the poker compactor. This is where a suction duct extends that is connected with a vacuum connection or a vacuum source for discharging the sucked-off air.

Preferred configurations are provided with a lifting drive. The drive enables to lower and raise the poker compactor and/or the carrier device. Particularly preferably the drive raises respectively lowers the carrier device so that it likewise raises respectively lowers the poker compactor. This allows to lower the poker compactor into an open package for compacting the bulk material present in the open package. After compacting the drive lifts the poker compactor back out of the open package.

In preferred configurations the outer wall consists at least partially of an air-permeable filter device. The air-permeable filter device is preferably exchangeable and supported by a supporting device. The outer wall and/or the filter device may be exchangeable. The outer wall and/or the filter device are preferably supported by a supporting device. The outer wall and/or the filter device may be self-supporting.

The air-permeable filter device may consist of a single- or multiple-ply filter layer. It is for example possible to use wire mesh for the filter device. Other materials are likewise conceivable for the filter such as sintered surfaces. Particularly preferably the pores are smaller than the smallest particle size. The protective device provides in particular a frame or a supporting body on which at least one filter layer is applied.

Preferably the vacuum connection is connected with a flexible hose. The vacuum connection may be non-rotatably connected with the poker compactor and may rotate along as the poker compactor rotates. It is also possible for the poker compactor to be rotatably received for example on a vacuum distributor. Then a number of poker compactors may be supplied with vacuum through a vacuum distributor.

In simple configurations the vacuum connection respectively the vacuum distributor is centrally provided at or connected to the top end of the poker compactor. What is possible is e.g. to use a rotary joint or a flexible hose provided for suitable twisting.

An elongated poker compactor configuration is preferred. Preferably the ratio of length to diameter of the poker compactor is above 3 or above 5 or above 10. The ratio of length to diameter may in particular relate to that portion of the poker compactor that is actively involved in suction. For example if the poker compactor substantially consists of a tube device having a bottom tube unit and a top tube unit and if suction is only provided from the bottom tube unit, then the ratio of length to diameter may relate to the length and the diameter of the bottom tube unit. In all the configurations a slim poker compactor is preferred wherein the active surface increases with larger diameters.

If two or more poker compactors are used, then two or more poker compactors may be received on one shared carrier device. Preferably each of the poker compactors is received for pivoting about its own longitudinal axis. The pivot device may show one shared drive for pivoting two or more poker compactors. It is possible that one shared cylinder drive serves to pivot two or more poker compactors.

Furthermore the invention relates to a packaging system comprising an open package provided to be filled with bulk material and at least one packaging machine. The packaging machine comprises at least one filling spout for filling open packages with bulk material. Furthermore at least one compacting device is provided as has been described above. Such a compacting device in particular comprises a poker compactor accommodated on a carrier device for compacting bulk material in the open package. The poker compactor comprises an outer wall that is at least partially gas-permeable and connected with a suction duct. The poker compactor is suitable to be inserted into an open package for the poker compactor to come into contact with the bulk material and to degas and compact the bulk material in the open package. The poker compactor has a longitudinal axis around which it is pivotable. A packaging system thus equipped also has many advantages.

In a specific embodiment a pressure sensor may be provided to determine the filling pressure within the bulk material. It is also possible and preferred to provide a fill level sensor for detecting the fill level in the package. If the fill level for example exceeds a predetermined measure, the compacting device respectively the poker compactor may enter the package and perform compacting of the filled bulk material. The compaction time may be extended or cut short in dependence on the fill level.

The poker compactor is in particular height-adjustable and can be inserted into the package through the filling spout or employed in a station not provided with a filling spout. It is also possible for the poker compactor to be provided for insertion into the package adjacent to the filling spout.

The method according to the invention serves to compact bulk material in an open package. A poker compactor is at least partially inserted into the open package for degassing and compacting bulk material in the open package. The poker compactor is rotated about its longitudinal axis prior to and/or during retraction out of the package. Then in particular any adhering bulk material is wiped off. Moreover, rotation of the poker compactor serves to promote degassing of the bulk material. For example the rotation breaks up any adhering bulk material lumps or structures.

The method may be used directly during filling an open package wherein at least one bulk material is filled into an open package in a filling process. A poker compactor of a compacting device is inserted into the open package for degassing and compacting the bulk material in the open package. The poker compactor is rotated about its longitudinal axis prior to and/or during retraction out of the package.

In all the configurations of the method it is preferred to insert the poker compactor into an at least partially empty package. It is for example possible to insert the poker compactor into the package prior to beginning the filling process. Alternately it is possible to insert the poker compactor into the partially or completely filled package only after the filling process or following a first step of the filling process.

Preferably the poker compactor is pivoted multiple times. Intermittent pivoting of the poker compactor is preferred. The poker compactor may also be pivoted continuously.

Preferably, air is sucked out of the poker compactor while bulk material is filled into the package.

In preferred configurations the poker compactor is pivoted or rotated about its longitudinal axis at least once during the compaction process. This is for loosening any adhering bulk material. Pivoting may be performed while bulk material is being filled.

It is preferred to pivot the poker compactor about its longitudinal axis at least once after cutting off the vacuum supply. After cutting off the vacuum supply, loosening of bulk material particles on the outer surface of the outer wall of the poker compactor is facilitated.

In preferred specific embodiments, air or compressed air is supplied to the (inner section of the) poker compactor after cutting off the vacuum supply. Air may be supplied for example through the suction duct. Such air supply may be provided at the end of or after the filling process.

The poker compactor is preferably pivoted while air is being fed to the poker compactor. This still further supports loosening of bulk material particles on the outer surface of the outer wall. This means the loosened bulk material particles are held distanced from the air-permeable surface of the poker compactor so that they are not dragged along due to surface friction as the poker compactor is pulled upwardly.

In all the configurations it is preferred to supply air in the form of at least one air impulse. Thus for example at specific points of time at least one air impulse respectively gas impulse may be supplied. The pulsed supply of air or other gas still further supports the detaching of bulk material particles.

An air impulse or compressed air impulse (depending on the desired impulse strength) leads to effective detaching of adhering particles. Multiple air impulses or compressed air impulses are likewise possible. It is also possible to supply air permanently. At particular points of time the air supply may be increased by increased air impulses.

Preferably the poker compactor is pivoted while the poker compactor is being pulled upwardly out of the package. The poker compactor may be pivoted back and forth a number of times. Multiple pivoting of the poker compactor is possible in all the cases and configurations described above. Multiple pivoting increases efficiency.

In all the configurations it is preferred to not suck off air until the fill level of the bulk material in the package substantially completely covers the vacuum suction wall. This is to ensure that not too much ambient air is aspirated which would decrease efficiency.

On the whole the poker compactor may also be referred to as a vacuum tank or vacuum lance. Thus the term "poker compactor" may continuously be replaced by the term "vacuum tank" or "vacuum lance" or other synonyms.

Generally the compacting device according to the invention shows considerable advantages. The rotary motion of the poker compactor enables shorter blow-off times. Optionally, blow-off for removing material adhering to the outer surface of the poker compactor may not be required. At any rate the compressed air consumption is decreased since less air or shorter air blasts need to be supplied. This also decreases the consumption of vacuum.

Another advantage is that less air impulses for blowing off the outer surface of the poker compactor causes less introduction of air into the product. Overall the cleaning times are shortened.

The invention allows increased performance since the required duration decreases. The poker compactor can be relieved of adhering particles faster. On the whole the outer surface will show less caking which cannot be blown off. The product shears itself off.

One considerable advantage is that less bulk material falls off the poker compactor as it is pulled out, in particular after removing the open package from the filling spout. This achieves higher weight accuracy. Furthermore, cleanliness increases.

During the filling process the poker compactor respectively vacuum lance may be present in the package or bag or it is inserted into the open package respectively the open-mouth bag after the filling process. The compaction is performed by suction. Optional support may be provided by a compacting device acting externally, for example a vibrating table or the like. Alternately an imbalance device may be incorporated in the compacting device. In the case of products prone to heavy caking, blowing off once or periodically or multiple times is possible. Intermittent pivoting during suction is also possible. The vacuum may be reduced or cut off during one pivoting process or an air impulse is applied to cause the particles to detach.

For blowing off the poker compactor may be connected with the ambience (or an excess pressure source) through a valve, so that air at atmospheric pressure (or excess pressure) enters. A pressure surge may also be applied. The poker compactor may rotate or pivot simultaneously or time-delayed. In a preferred configuration rotation and blowing off takes place simultaneously.

Continuous or periodic pivoting back and forth during pulling out is possible. It is also possible to firstly pivot back and forth and thereafter to pull out the poker compactor.

Further advantages and features of the present invention can be taken from the exemplary embodiment which will be described below with reference to the enclosed figures.

DETAILED DESCRIPTION

Figure 1:
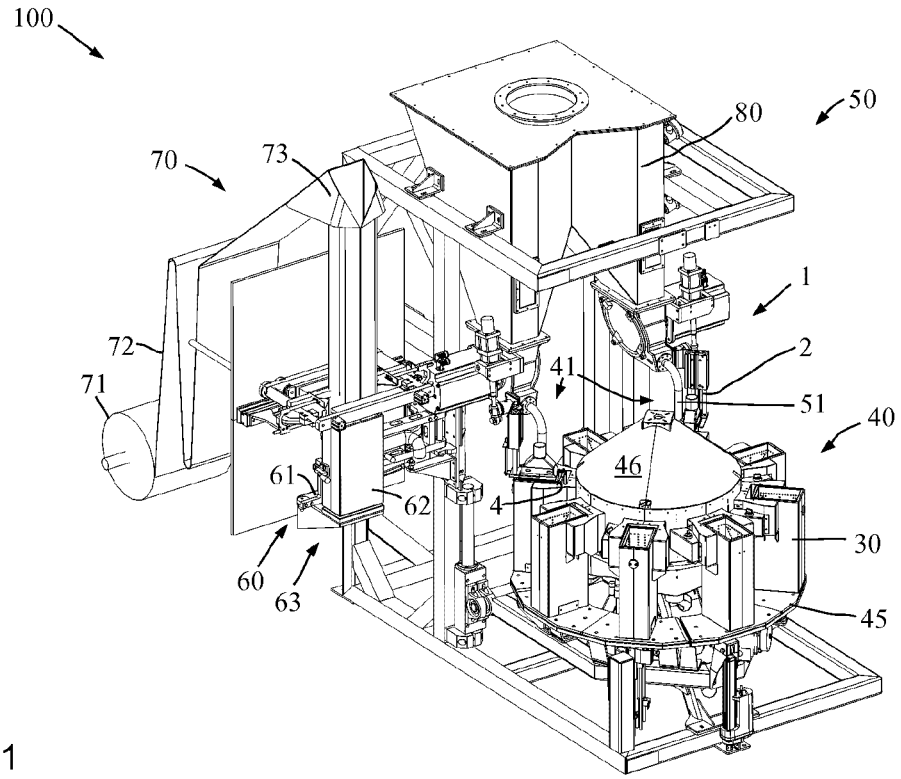
FIG. 1 a schematic perspective view of a packaging system.

FIG. 1 shows the basic structure of a packaging system 100 in a perspective total view. The packaging system 100 serves to fill bulk materials into open packages 4, in this case open-top bags. The open packages 4 provided for processing consist of a flexible material and in particular of a plastic material. Filling paper packages is likewise possible. The packaging system 100 comprises a packaging machine 50 including a filling carousel 40. A bag source 70 provides the required packages 4 and an intermediate silo 80 serves for intermediate buffering of the bulk material provided for filling.

The bag source 70 provided is a film roll 71 on which a sheet of film 72 is wound. The sheet of film 72 wound onto the film roll 71 is fed toward a shaping shoulder 73. There the sheet of film 72 made of plastic film is guided around the shoulder and a longitudinal seam is made (in particular welded) so as to create a continuous tubular film.

The bag bottom is manufactured at the handover station 60 by making suitable weld seams transverse to the longitudinal extension of the tubular film. Moreover, corner welding seams are preferably inserted to produce block-shaped filled bags. The tubular film provided at a suitable cross section is conveyed further and inserted into the receiving box 62 of the handover station 60. There the open package 4 intended for filling is form-fittingly received. For the feed the tubular film is cut to size so as to manufacture the open-top end of the open package 4.

Manufacturing the open-top package 4 is also possible from a prefabricated, for example extruded film tube, or completely prefabricated open packages 4 in the shape of flexible sacks or bags may be supplied from a magazine or the like.

FIG. 1 illustrates the pivot arm 61 in the pivot position 63 of the handover station 60.

The apparatus 100 comprises a basic frame to which the filling carousel 40 and the further components are attached. The part 45 of the apparatus is stationary while the part 46 rotates in operation. Each of the filling stations is provided with various handling stations wherein a handling station is provided for filling in high speed flow and another handling station 41, for filling in low speed flow. Further handling stations are provided for compacting the filled bulk material. Compacting the filled bulk material may be provided in each of the handling stations. Thus, a compacting device 1 is used in the handling station 41.

This filling carousel 40 is operated indexed. The required bulk material is supplied from the intermediate silo 80.

If the compacting achieved on the filling carousel 40 is not sufficient, a separate compaction station may be installed downstream, as it is described in the as yet unpublished German patent application, application No. 10 2017 109 873.

Figure 2:
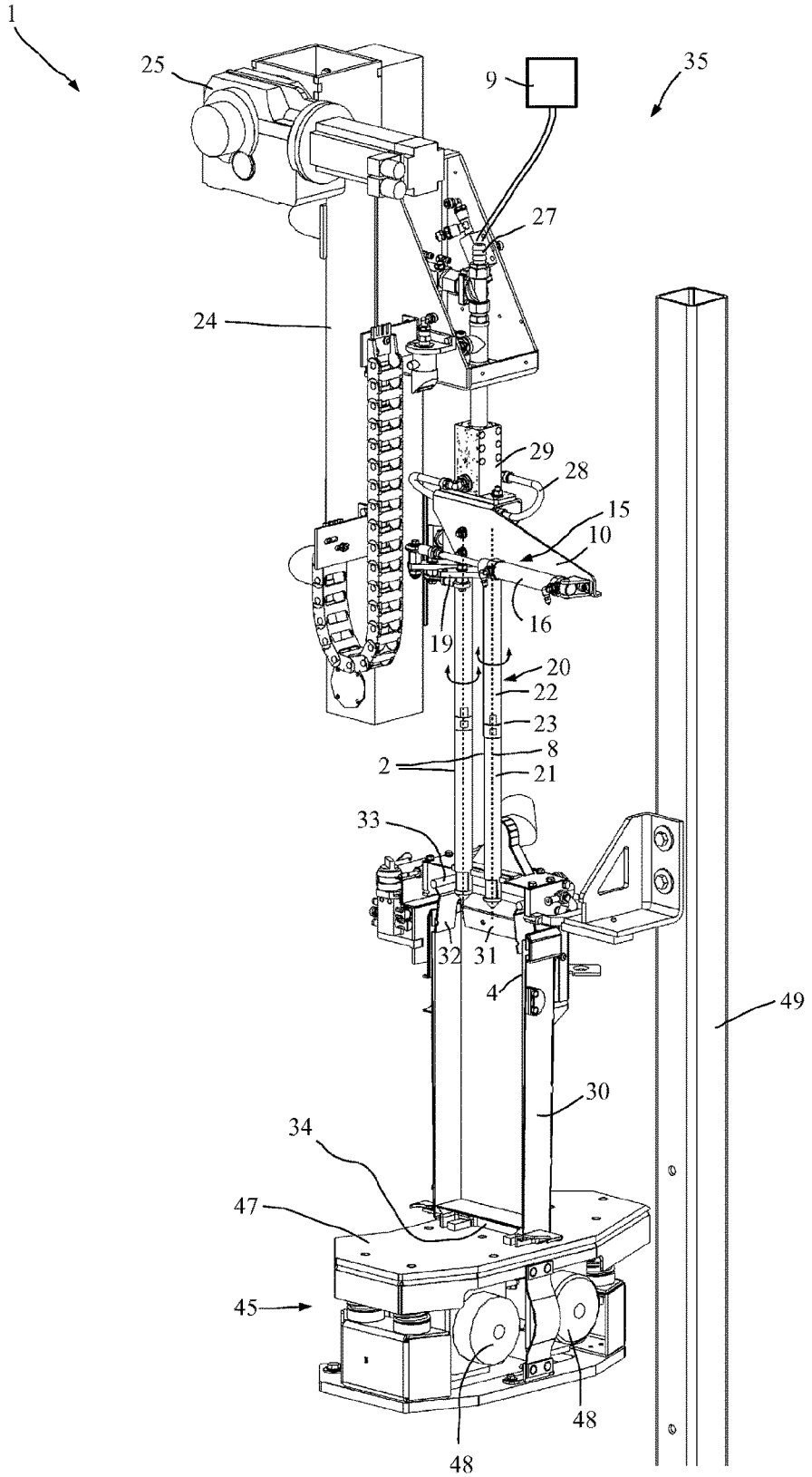
FIG. 2 a compacting device of the packaging system of FIG. 1 in a top position.

FIG. 2 shows an enlarged perspective illustration of the compacting device 1 of FIG. 1 which may be employed in a great variety of handling stations.

At any rate the compacting device 1 comprises a carrier device 10 receiving at least one (presently two) poker compactors 2 for pivoting around their own longitudinal axes.

The compacting device 1 is illustrated in FIG. 2 in a nearly entirely lifted top position 35 in which the bottom ends of the poker compactors 2 only just extend into the top ends of the receiving box 30. As the receiving box 30 is indexed further, the compacting device 1 is displaced entirely upwardly.

The poker compactors 2 of the compacting device 1 are received by the carrier device provided to pivot separately. The pivot device 15 with the cylinder drive 16 serves to jointly pivot the poker compactors 2 around the pertaining longitudinal axes 8. The cylinder drive 16 pivots both the poker compactors 2 back and forth. A coupling linkage 19 pivotally couples the poker compactors 2 with the cylinder drive 16. The poker compactors 2 are rotatably received by their top ends in the vacuum distributor 29 which via a vacuum connection 27 and a flexible hose 28 is connected with a schematically shown vacuum source 9.

The lifting motor or lifting drive 25 of the lifting device 24 serves for height adjustment of the carrier device 10 and thus of the tube devices 20. The carrier device 10 may be configured as a console and is connected with the lifting device via the vacuum distributor 29.

The poker compactor 2 is substantially configured as a tube device 20 and comprises a bottom tube unit 21 and a top tube unit 22. It is possible to only provide the bottom tube unit 21 with a gas-permeable outer wall 5 that serves as a vacuum suction wall 7. The top tube unit 22 may show a gas-impervious outer wall 5. Preferably the bottom tube unit 21 and the top tube unit 22 are configured cylindrical at least over substantial sections.

In FIG. 2 the packaging machine 50 also shows part of the stationary part 45 of the filling carousel 40, that is the vibrating table 47 provided with two vibrating drives 48 which cause vertical vibrating motions of the vibrating table 47. The vibrating motion is transmitted via the vibrating table 47 to the bottom plate respectively gliding plate 34 which is disposed for vertical movement inside the receiving box 30, which is shown in section. The receiving box 30 illustrates (again, in section) an open package 4 whose top walls are reliably held open at the top end by means of the flaps 31 and 32. This is to ensure that as the poker compactors 2 enter the receiving box 30 from above, the poker compactors 2 safely move into the interior of the open-top package 4 without e.g. being caught on the wall of the package. The flaps 31 on the longitudinal face and 32 on the short sides of the receiving box are controlled by one or more flap drives 33 (such as pneumatic cylinders).

Above the flaps 31 and 32 a broom- or brush-type cleaning unit 37 may be provided for brushing off the outer surface of the poker compactors emerging from the receiving box 30 to still further enhance cleanliness overall.

Figure 3:
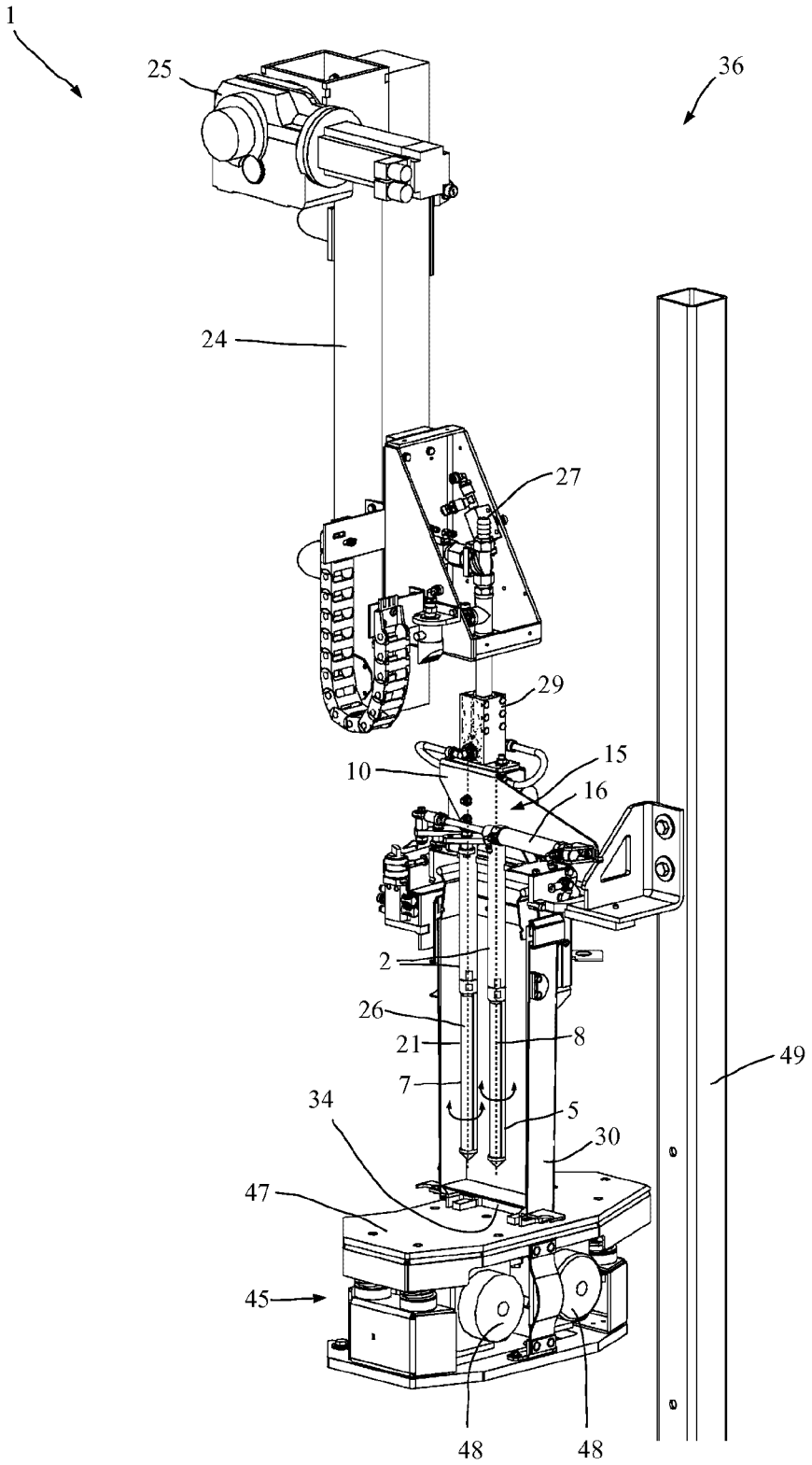
FIG. 3 the compacting device of FIG. 2 in a bottom position.

FIG. 3 shows the compacting device 1 of FIG. 2 with the compacting device 2 illustrated in a bottom position 36 in which the poker compactors 2 are inserted deep in the receiving box 30 and thus in the open-top package 4.

The outer surfaces of the bottom tube units 21 of the poker compactors 2 show a gas-permeable filter device 11 and form a vacuum suction wall 7 through which air enters the interior of the bottom tube unit 21 and the vacuum chamber 26 and the suction duct 6, and is sucked off upwardly.

The separation point 23 of the poker compactors 2 serves to exchange the bottom tube units 21 respectively the filter devices 11 mounted thereon, which are subjected to heavy wear and may clog or congest over time so as to require external cleaning or replacement.

Figure 4:
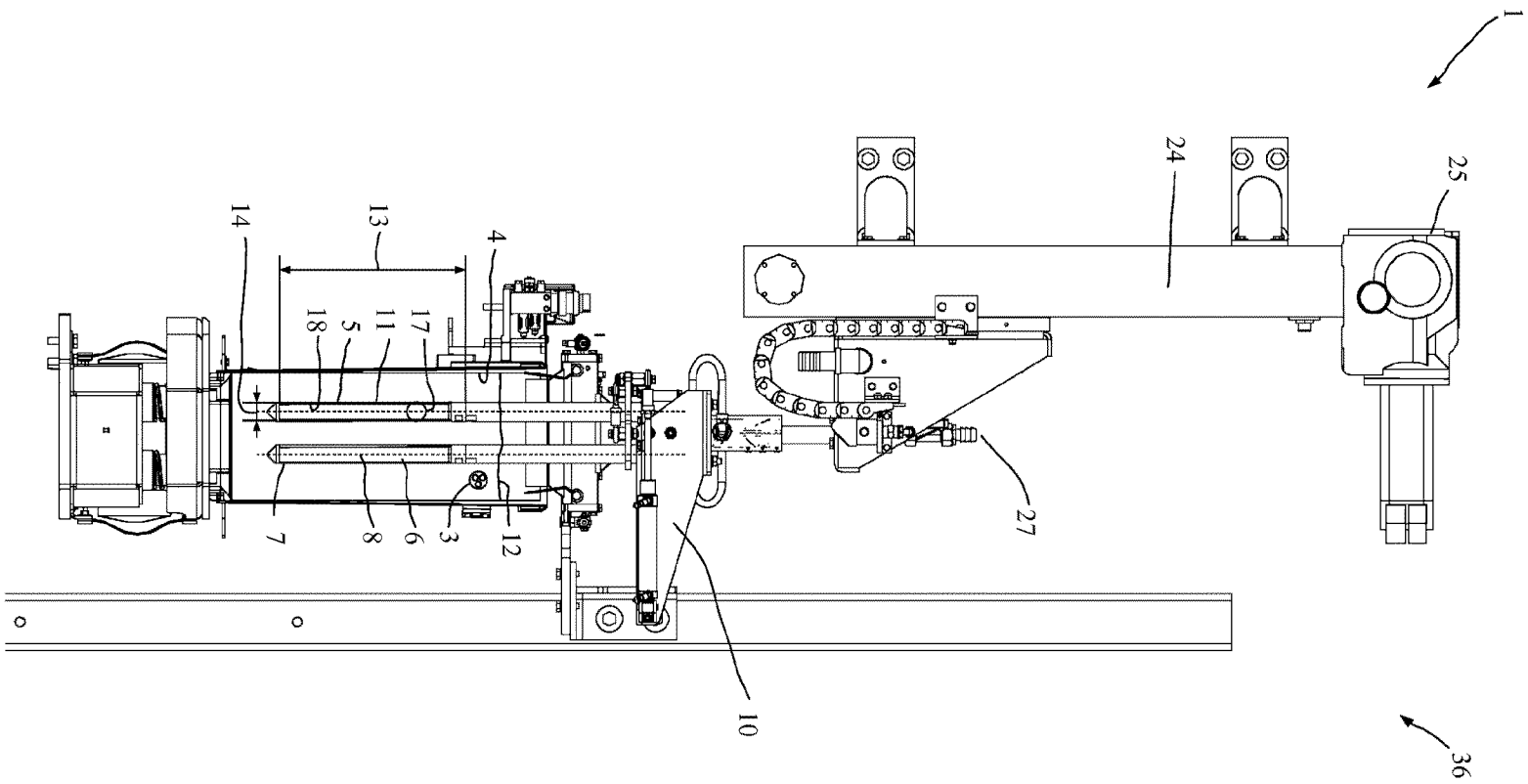
FIG. 4 the compacting device of FIG. 3 in a side section.

FIG. 4 finally shows a sectional transverse view of the compacting device 1 of FIG. 3.

It can be clearly seen that the pivot axis respectively longitudinal axis 8 of the poker compactors 2 extends inside the cross section 17. The longitudinal axes 8 form the axes of symmetry of the tube device 20 of the poker compactor 2. The bottom tube unit 21 shows a length 13 that is multiple times larger than the diameter 14 of the bottom tube unit 21 or the poker compactor 2 respectively since the bottom tube unit 21 and the top tube unit 22 show identical diameters. The ratio of the length 13 to the diameter 14 of the bottom tube unit is above 3 and in particular above 5 and in preferred configurations it may be above 10. The ratio of the total length of the poker compactor 2 to the diameter 14 of the poker compactor 2 is in particular still higher and may reach, and exceed, values of 5 or 10 or 20.

The FIG. 4 shows an exemplary filled level 12 of the bulk material 3.

Figure 5:
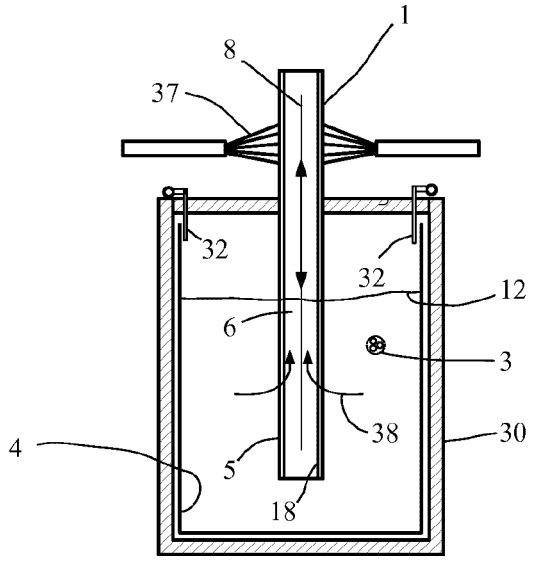
FIG. 5 a schematic view of another compacting device.

FIG. 5 shows a schematic cross section of a receiving box 30. An open-mouth bag representing the package 4 is received therein. The package 4 is filled with bulk material 3 up to the filled level 12. The top edge of the film wall of the package 4 is held open by flaps 32. The compacting device 1 is immersed in the bulk material. Air is sucked out of the bulk material in the direction of the arrows 38. Above the flaps 31 and 32 a broom-type or brush-type cleaning unit 37 is provided whose bristles bear against the compacting device 1. As the poker compactor 2 emerges upwardly its outer surface is brushed off to still further enhance cleanliness overall.

The air-permeable filter device 11 is preferably exchangeably supported by a supporting device 18 or is configured self-supporting. It is conceivable that the supporting device 18 is part of the filter device 11. The filter device 11 may for example show multiple filter layers, one or more of which form a supporting device 18.

If a vacuum-operated poker compactor is cleaned by means of an air blast then—without the present invention—the filter device is not uniformly cleaned from adhering product in all places. Loosely resting or adhering regions [sic; probably: particles] detach faster. The prior art provides for the pressure impulse to disintegrate due to the already blown off spots so that the remaining spots or pores are cleaned insufficiently or not at all. The prior art attempts to compensate this by extending the blowing-off period (duration of the pressure impulse) or increasing the air quantity or the air pressure. This results in reduced performance and an undesirably increased entry of air into the package. Already by the rotary motion the invention enables a largely satisfactory removal of adhering bulk material. Moreover short air blasts can clean most of the filter device.

On the whole an advantageous compacting device and an advantageous method for compacting bulk materials in open packages are provided with which to achieve improved cleanliness of the system. At the same time, filling and compacting is faster while energy consumption is reduced as well.

List of reference numerals:

| | |
|---|---|
| 1 | compacting device |
| 2 | poker compactor, vacuum lance |
| 3 | bulk material |
| 4 | package |
| 5 | outer wall |
| 6 | suction duct |
| 7 | suction wall |
| 8 | longitudinal axis |
| 9 | vacuum source |
| 10 | carrier device |
| 11 | filter device |
| 12 | filled level |
| 13 | length of 2 |
| 14 | diameter of 2 |
| 15 | pivot device |
| 16 | cylinder drive |
| 17 | cross section of 2 |
| 18 | supporting device |
| 19 | coupling linkage |
| 20 | tube device |
| 21 | bottom tube unit |
| 22 | top tube unit |
| 23 | separation point |
| 24 | lifting device |
| 25 | lifting drive |
| 26 | vacuum chamber |
| 27 | vacuum connection |
| 28 | hose |
| 29 | vacuum distributor |
| 30 | receiving box |
| 31 | flap |
| 32 | flap |
| 33 | flap drive |
| 34 | gliding plate |
| 35 | top position |
| 36 | bottom position |
| 37 | cleaning unit |
| 38 | arrow |
| 40 | filling carousel |
| 41 | handling station |
| 45 | stationary part |
| 46 | movable part |
| 47 | vibrating table |
| 48 | vibrating drive |
| 49 | frame |
| 50 | packaging machine |
| 51 | filling spout |
| 60 | handover station |
| 61 | pivot arm |
| 62 | receiving box |
| 63 | pivot position |
| 70 | bag source |
| 71 | film roll |
| 72 | sheet of film |
| 73 | shaping shoulder |
| 80 | intermediate silo |
| 100 | packaging system |

The invention claimed is:

1. A compacting device comprising: a poker compactor received on a carrier device for compacting bulk material in an open package; the poker compactor comprises an outer wall that is at least partially gas-permeable and connected with a suction duct; the poker compactor is suitable to be inserted into an open package to cause the poker compactor to come into contact with the bulk material and to degas and compact the bulk material in the open package;

and the poker compactor shows a longitudinal axis around which it is pivotally received.

2. The compacting device according to claim 1, wherein a pivot device is provided by means of which the poker compactor can be pivoted.

3. The compacting device according to claim 2, wherein the pivot device comprises a cylinder drive and wherein the pivot device is in particular received on the carrier device.

4. The compacting device according to claim 1, wherein the longitudinal axis of the poker compactor is disposed inside the cross section of the poker compactor.

5. The compacting device according to claim 1, wherein the outer wall of the poker compactor and/or the poker compactor is/are rotationally symmetrical.

6. The compacting device according to claim 1, wherein a lifting drive is provided.

7. The compacting device according to claim 1, wherein the poker compactor comprises a bottom tube unit and a top tube unit exchangeably connected with one another in a separation point.

8. The compacting device according to claim 1, wherein the outer wall at least partially consists of an air-permeable filter device.

9. The compacting device according to claim 8, wherein the outer wall and/or the filter device is/are exchangeable.

10. The compacting device according to claim 8, wherein the outer wall and/or the filter device is/are supported by a supporting device.

11. The compacting device according to claim 8, wherein the outer wall and/or the filter device is/are self-supporting.

12. The compacting device according to claim 1, wherein the suction duct is connected with at least one vacuum connection and/or a vacuum source.

13. The compacting device according to claim 12, wherein the vacuum connection is connected with a flexible hose and/or wherein the vacuum connection is non-rotatably connected with the poker compactor and pivots along as the poker compactor is pivoted.

14. The compacting device according to claim 1, wherein the poker compactor is configured elongated and wherein the ratio of the length to the diameter of the poker compactor is larger than 3 or 5 or 10.

15. The compacting device according to claim 1, wherein the carrier device receives at least two poker compactors.

16. A packaging system comprising: at least one open package provided to be filled with bulk material; at least one packaging machine having at least one filling spout for filling open packages with bulk material; and at least one compacting device according to claim 1 is provided.

17. The packaging system according to claim 16, wherein the poker compactor is height-adjustable.

18. The packaging system according to claim 16, wherein the poker compactor can be inserted into the package through the filling spout.

19. A method for compacting bulk material in an open package, comprising: a poker compactor is inserted into the open package to degas and compact bulk material in the open package; and the poker compactor is pivoted about its longitudinal axis prior to and/or during retraction out of the package.

20. The method according to claim 19, wherein the poker compactor is inserted into an at least partially empty package.

21. The method according to claim 19, wherein air is sucked out of the poker compactor while bulk material is being filled into the package.

22. The method according to claim 19, wherein the poker compactor is pivoted about its longitudinal axis at least once during the compaction process.

23. The method according to claim 19, wherein the poker compactor is pivoted about its longitudinal axis at least once during the compaction process after the vacuum supply is cut off.

24. The method according to claim 19, wherein air or compressed air is supplied to the poker compactor after the vacuum supply is cut off.

25. The method according to claim 24, wherein the poker compactor is pivoted while air is supplied to the poker compactor.

26. The method according to claim 24, wherein air is supplied in the shape of at least one air impulse or multiple air impulses and/or permanently.

27. The method according to claim 19, wherein the poker compactor is pivoted while the poker compactor is pulled up out of the package.

28. The method according to claim 19, wherein air is not sucked off until the fill level of the bulk material in the package substantially entirely covers the vacuum suction wall.

29. The method according to claim 19, wherein the poker compactor enters an already filled package.

30. The method according to claim 19, wherein the poker compactor is pivoted multiple times.

31. The method according to claim 19, wherein the poker compactor is pivoted intermittently.

32. The method according to claim 19, wherein the poker compactor is pivoted continuously.

* * * * *